US005275100A

United States Patent [19]

Harpold et al.

[11] Patent Number: 5,275,100

[45] Date of Patent: Jan. 4, 1994

[54] METHOD AND APPARATUS FOR HANDLING PRINTING INK

[75] Inventors: Charles W. Harpold, Grand Rapids; Eugene H. Kemp, Middleville, both of Mich.

[73] Assignee: Harco Graphic Products, Inc., Grand Rapids, Mich.

[21] Appl. No.: 907,398

[22] Filed: Jul. 1, 1992

Related U.S. Application Data

[62] Division of Ser. No. 640,475, Jan. 4, 1991.

[51] Int. Cl.[5] ..... B41F 31/02; B41F 31/20

[52] U.S. Cl. ..... 101/335; 101/483; 15/70

[58] Field of Search ..... 101/364, 363, 350, 207–210, 101/335, 366, 114, 123, 129, 483; 15/70, 71, 72, 57, 246.5, 256.5, 256.51, 257.07, 104.1 C; 222/151, 149, 586, 342

[56] References Cited

U.S. PATENT DOCUMENTS

| | | | |
|---|---|---|---|
| 940,060 | 11/1909 | Ranney | 15/72 |
| 1,076,066 | 10/1913 | Runnels | 15/72 |
| 3,685,085 | 8/1972 | Jaffa | 101/114 X |
| 4,175,489 | 11/1979 | Gattus | 101/366 |
| 4,355,734 | 10/1982 | Moore | 222/63 |
| 4,817,523 | 4/1989 | Harpold et al. | 101/123 |

*Primary Examiner*—J. Reed Fisher

*Attorney, Agent, or Firm*—Price, Heneveld, Cooper, DeWitt & Litton

[57] ABSTRACT

An apparatus for handling printing ink includes a bucket support positioned over a container that allows buckets to be placed up-side-down on the bucket support and rotated to wipe the inside of the bucket substantially clean. A cover for the container is moveable between an open position which allows the bucket to be placed on the bucket support and a closed position wherein the cover and bucket cooperate to form a substantially air tight closure over the container. Paddles urge ink from the container toward a discharge opening such that ink may be dispensed through various dispensing systems.

7 Claims, 2 Drawing Sheets

METHOD AND APPARATUS FOR HANDLING PRINTING INK

This is a divisional application of co-pending application Ser. No. 07/640,475 filed on Jan. 4, 1991 entitled METHOD AND APPARATUS FOR HANDLING PRINTING INK.

BACKGROUND OF THE INVENTION

This invention relates to a method and apparatus for handling ink, and particularly to a method and apparatus for handling viscous ink which does not flow well.

Ink manufacturing companies prefer to sell ink in five gallon or larger containers with various supply companies re-bucketing it to gallons and quarts as they desire. Many companies using ink choose to work with five gallon containers since containers larger than five gallons would be difficult to handle. Further, inventory is easier to control with five gallon containers. Alternatively, the price of ink in one gallon containers is too high to justify the increased expense.

Various pumping systems are offered by a number of pump manufacturers to assist in the re-bucketing process and also to automatically distribute the ink to various job sites as needed. However, the cheaper pumping systems are not able to keep viscous ink fed to the pump and thus the pump tends to work in fits and spurts. The more effective of these pumping systems are expensive. Further, both types of pumping systems tend to leave a considerable amount of ink in the supply bucket after the pump has completed its function. This requires that the bucket be hand scraped to salvage the remaining ink. This also makes it impractical to recycle the container.

Plastisol ink in particular is difficult to work with since it will not pour and sticks to everything that it touches. One system for dealing with this problem utilizes a pressure plate which fits into the top of the ink supply bucket and includes an opening through which an ink supply pipe is slideably fitted. The pipe is connected by a tube to the ink pump. As the ink is drawn from the container, the plate slides down the supply pipe and the bucket side walls to force the ink downwardly and prevent cavitation around the pipe opening at the container bottom. However, the supply bucket sides are usually tapered such that the pressure plate cannot be sized to cleanly wipe the container sidewalls. This allows the plastisol ink to slip between the plate and the bucket sides, thus creating a mess and leading to further waste. Also, considerable ink remains in the bottom of the supply bucket when the pump is done.

SUMMARY OF THE INVENTION

The present invention includes an inverted generally "L" shaped bucket support mounted over an ink holding and dispensing container. The bucket support includes a first and second wiper mounted at an angle such that the wipers closely contact the side wall and bottom, respectively, of an ink bucket inverted over the bucket support. The supply bucket can be wiped substantially clean by rotating the up-side-down bucket on the bucket support.

These and other features, objects and advantages of the present invention will become apparent upon reading the following description thereof, together with reference to the accompanying drawings and claims in which:

DETAILED DESCRIPTION OF THE PREFERRED EMBODIMENTS

Figure 2:
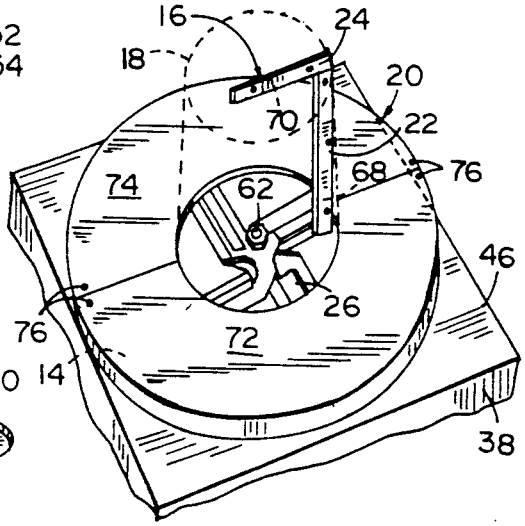
FIG. 2 is a top perspective view of the apparatus with the supply bucket shown in phantom.
Figure 3:
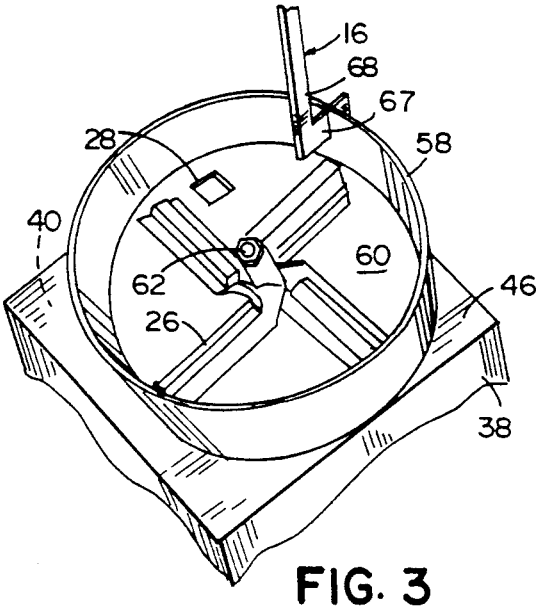
FIG. 3 is a top perspective view of the apparatus shown in FIG. 1 with the supply bucket and cover removed.

In the preferred embodiment, ink handling apparatus 10 includes a frame 12, a holding and dispensing container or tub 14 for receiving ink mounted on frame 12, and an inverted "L" shaped bucket support 16 which is positioned over container 14 and is designed to hold bucket 18 in an up-side-down position over container 14. Container 14 is provided with a container cover 20 which closes on bucket 18 and over container 14 to form a substantially air tight enclosure for ink held within container 14 (FIG. 2). Squeegees or scrapers 22 and 24 are fastened to and extend from bucket support 16 such that the sides and bottom of a supply bucket or pail 18 can be wiped substantially clean as bucket 18 is rotated on support 16. Paddles or impellers 26 are located inside container 14 for urging ink toward a discharge opening 28 in container 14 (FIG. 3). Pump 30 which receives ink from discharge opening 28 through supply or feeder hose 32 (FIG. 4) pumps ink to a remote location through one or more delivery hoses 34 such as to printing press 36.

Figure 1:
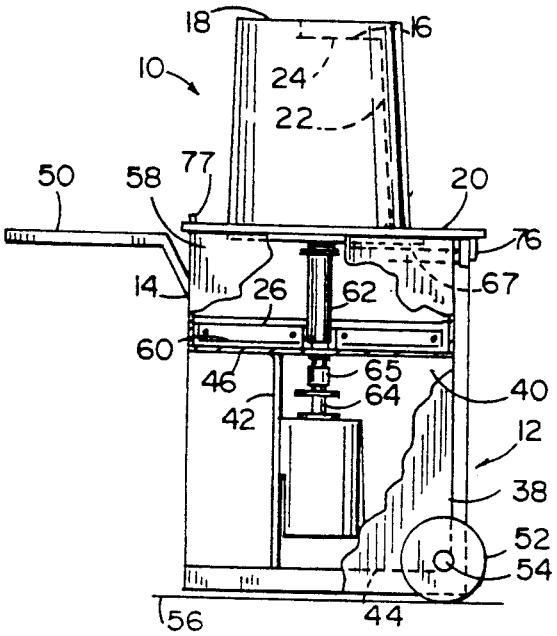
FIG. 1 is a side elevational view of an apparatus for handling printing ink embodying the present invention shown with a supply bucket on the bucket support.
Figure 4:
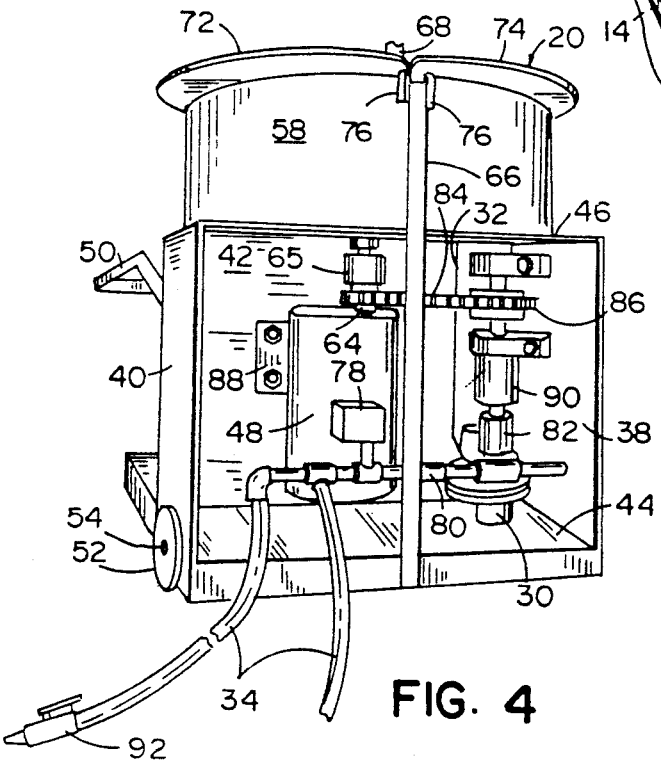
FIG. 4 is a rear perspective view of the apparatus shown in FIG. 1.

Frame 12 is a box-like structure having sides 38, 40, and 42 connected to flat base or bottom 44 and flat top 46 (FIGS. 1 and 4). Members 38–46 form a rearwardly facing open area which is somewhat sheltered from the upper and front portions of apparatus 10. Thus, the open area is conducive for housing components which are preferably kept clean, such as motor 48 and pump 30 discussed below. Top 46 and bottom 44 also extend forwardly of members 38–42 forming a mini-workstation. Bottom 44 and centrally located side 42 are easily cleaned and, thus, increase the maintainability and cleanliness of apparatus 10.

Frame 12 is made portable by attachment of handles 50 and wheels 52 to frame sides 38-40. It is contemplated that a number of different handle designs and wheels can be used. In the preferred embodiment, two handles 50 extend upwardly and outwardly so that a single operator can easily grip them. Wheels 52 are interconnected by axle 54 which extends to either side of frame through frame side members 38–40.

Container 14 is formed by joining cylindrical side 58 to top 46, thus forming an open upwardly facing container with bottom 60 (FIGS. 1, 3 and 4). Located in flat bottom 60 is a discharge opening 28. Paddles or impellers 26 are located in the bottom of container 14 and ar mounted to a center post 62. Center post 62 is journaled for rotation in and extends through flat bottom 60 (and frame top 46) and connects to a central shaft 64 of a motor 48. Motor 48 is mounted on central side 42 of frame 12 and includes an upwardly projecting drive shaft 64 aligned with center post 62. Center post 62 and shaft 64 are connected by a universal joint 65 which allows for minor misalignment therebetween. Paddles 26 are oriented such that as they are rotated by center post 62, they wipe the bottom 60 of container 14 and urge the ink through discharge opening 28.

Bucket support 16 includes an upwardly extending stand 66 fastened to the rear of frame 12. Stand 66 supports the rear of frame 12 and container 14 providing increased strength and rigidity thereto. Horizontal arm 67 extends inwardly from the upper end of stand 66, arm 67 being located inside of cylindrical side 58 of container 14. An upwardly extending long wiper ar 68 rises above container 14 from the end of horizontal arm 67, and a laterally extending short wiper arm 70 is affixed to the end of long arm 68 and extends generally horizontally therefrom. Bucket support 16 is stiff enough to support the weight of a supply bucket or pail 18 placed up-side-down on bucket support 16. Arm 67 spaces arm 68 and 70 inwardly such that bucket 18 is positioned fully over container 14 when bucket 18 is placed onto bucket support 16. Arms 68 and 70 are connected at a angle similar to the angle formed by the bottom and side wall of bucket 18 such that bucket 18 may be rotated and wiped substantially clean as bucket 18 is rotated while resting in the up-side-down position on bucket support 16. Flexible members or squeegees 22 and 24 are bolted to arms 68 and 70 such that arms 68 and 70 act with a squeegee like scraping action to clean bucket 18.

Cover 20 is made of two flat "C" shaped cover members 72 and 74 that rest on the upper edge of container 14 (FIG. 2). Members 72, 74 are pivotally mounted to the rear of container 14 on vertical hinges 76 and hook together in front by latch 77. Cover members 72 and 74 form an opening that closes around bucket 18 to form a substantially air tight cover around bucket 18 and over container 14. Alternatively, cover members 72 and 74 open to allow placement of bucket 18 onto bucket support 16.

Pump 30 receives the ink through feeder hose 32 which is connected between discharge opening 2 and the inlet to pump 30 (FIG. 4). Pump 30 is a gear pump having a positive displacement output. It has been found that a gear pump is advantageous in this application since the grinding effect of the gear pump increases the smoothness of the ink. One or more delivery hoses 34 extend from the outlet of pump 30 to remote locations. A pressure switch 78 is connected in-line in hose 34 to sense pressure within hose 34. Pressure switch 78 is electrically connected to turn on pump 30 as pressure drops off in hose 34, or alternatively turn off pump 30 when the line pressure in hose 34 is sufficiently high. Delivery hose 34 also includes a check valve 80 located upstream of switch 78 to prevent backflow of the ink when pump 30 is shut off. Pump 30 includes an upwardly extending drive shaft 82 which is operably connected to shaft 64 of motor 48 by pump drive chain 84 and sprocket 86. Upwardly extending drive shaft 82 of pump 30 includes a universal joint 90 which facilitates use of apparatus 10 despite slight misalignment between pump shaft 82 and sprocket 86. Frame 12 can include a stiffener or mounting plate 88 which is mounted to frame central side 42. Plate 88 provides structural support for motor 48, pump 30, and related parts.

Apparatus 10 is designed to deliver ink to a printing press 36 either manually by nozzle shutoff 92 located on the end of hose 34 or automatically as discussed below. It is contemplated that printing press 36 will be a screen type printer including at least one print screen 94 with an overhead carriage 102 which carries a print squeegee 96 and flood bar 98 similar to that disclosed in U.S. Pat. No. 4,817,523 issued Apr. 4,1989, to Harpold et al. and entitled: FLAT BED SCREEN PRINTING PRESS. However, apparatus 10 could be used to supply any machine requiring a supply of ink r to repackage ink in smaller containers. In the preferred embodiment, ink is automatically delivered through delivery hose 34 to manifold 100 which deposits ink upon screen 94 and between squeegee 96 and flood bar 98.

Figure 7:
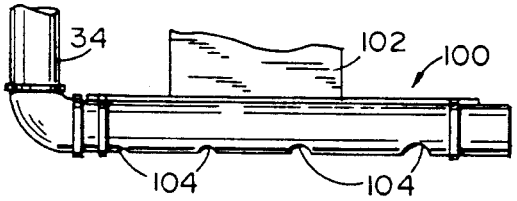
FIG. 7 is a front view of an ink delivery manifold for a printing press.
Figure 6:
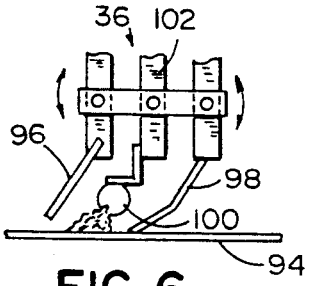
FIG. 6 is a schematic showing the location of an delivery ink manifold on a printing press.
Figure 8:
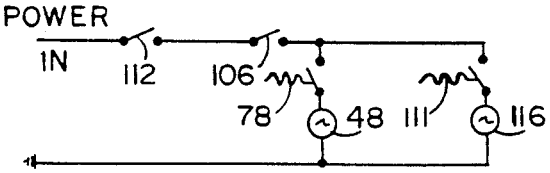
FIG. 8 is an electrical schematic.

Manifold 100 (FIGS. 6 and 7) is "T" shaped or "L" shaped as determined by accessibility to carriage 102. Manifold 100 comprises an elongated horizontal pipe having downwardly facing openings or slots of varying diameter designed to distribute the ink somewhat evenly across screen 94. It is contemplated that manifold 100 will have holes 104 of varying diameter to accomplish the even distribution, though manifold 100 could include flaps, dividers or features to better distribute the ink. It is also contemplated that the delivery of the ink to printing press 36 can be controlled by a number of means including: continuously, periodically based on a given number of cycles, periodically based on a timed basis (such as based on machine run time out of each minute), manually, or similar methods consisting of one or more combinations of the above. In the preferred embodiment shown, the automatic delivery of ink to printing press 36 is controlled by actuating switch 106 (FIG. 8) located at a station control panel (not shown).

Figure 5:
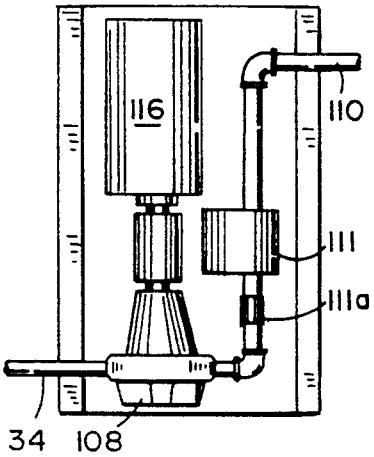
FIG. 5 is a plan view of a booster pump which can be used in conjunction with the apparatus as shown in FIGS. 1–4.

A further embodiment (FIG. 5) includes a booster pump 108 connected in series to delivery hose 34. Booster pump 108 assists pump 30 in distributing ink to remote locations without the problems of excessive line pressure build up. Booster pump 108 includes a second delivery hose 110, a second pressure switch 111 for detecting delivery hose line pressure, and second check valve 111*a* to eliminate back flow. It is contemplated that booster pump 108 is electrically connected to act based on input from pressure switch 111, however, alternative connections may be made as are required by specific situations.

The electrical circuit (FIG. 8) is connected so that power flows through main power-on switch 112 located near apparatus 10 and station control switch 106 located on printing press 36, though alternative connections can be made as desired. Station control switch 106 provides the control over the automatic delivery of ink to press 36 as described above. Electrical power is then conveyed to pressure switches 78 and 111 which are wired to turn on pump motors 48 and 116 when delivery line pressure drops too low, or alternatively, turn off pump motors 48 and 116 when line pressure reaches a maximum desired setting. Thus, the ink supply to each station can be controlled at each station on press 36.

In one embodiment (FIG. 4), a manual shutoff nozzle 92 is mounted to the end of delivery hose 34. The nozzle may be electrically connected with a switch to turn on pump 30 as the nozzle is opened, or alternatively pump 30 can be actuated by pressure switch 78 and/or pressure switch 111 as pressure in delivery hoses 34 and 110 drops off.

OPERATION

An operator adds an amount of ink to holding container 14 by dumping ink from bucket 18 into container 14. Bucket 18 is then placed up-side-down on bucket support 16 and rotated such that flexible squeegee members 22 and 24 on arms 68 and 70 wipe the sides and bottom of bucket 18 substantially clean. Thus, ink is held within holding and distributing container 14 and is ready to be distributed as required.

Ink is paddled through discharge opening 28 in container 14 by rotating paddles 26 which keeps a ready supply of ink within feeder hose 32. This ensures that pump 30 has a ready supply of ink to draw upon when it is activated. Pump 30 then forces ink through delivery hose 34 to a remote location as desired. A pressure switch 78 senses when pressure in delivery hose 34 is low and interacts with the electrical circuitry to turn pump 30 on (or off) as required. Check valve 80 prevents backflow of ink within delivery hose 34 due to residual line pressure when pump 30 is shut off. A control switch 106 located on printing press 36 allows the ink to be automatically delivered to printing press 36 as required. Control switch 106 may be activated a number of ways either manually or automatically as discussed previously. Delivery hose 34 deposits ink at press 36 on top of print screen 94 and between squeegee 96 and flood bar 98. Where the location of printing press 36 is a considerable distance or where a plant wide system distribution of ink is desired, a booster pump 108 is used to pump ink a greater distance without excessive pressure build up in delivery hose 34.

ALTERNATIVE EMBODIMENT

Figure 9:
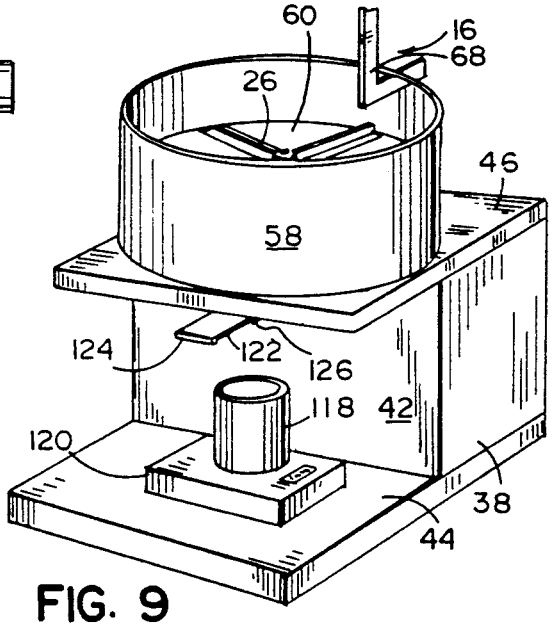
FIG. 9 is an elevated front perspective view of a second apparatus for handling printing ink embodying the present invention.

In another embodiment (FIG. 9), ink is dispensed directly to quart or one gallon pails 118 which are placed directly under discharge opening 28. A weigh scale 120 can be placed under discharge opening 28 to hold pail 118 to increase the accuracy of ink dispensed. In this embodiment, a slideable shutoff 122 is provided which shuts off discharge opening 28. Slideable shutoff 122 is a flat member with a front bend to provide a handle 124. Shutoff 122 is mounted within a track 126 allowing shutoff 122 to move horizontally.

It should be evident from the above description that an apparatus is provided for handling ink which is easy to use and reduces waste of ink. This is made possible by the unique arrangement which includes a bucket support mounted over the holding container which allows supply containers t be wiped substantially clean. One arrangement includes moving paddles which urge ink toward a discharge opening, the paddles providing a simple, inexpensive way to positively feed ink such as to a pump to prevent the pump from losing its prime. A booster pump can also be used to assist in moving the ink to remote locations where distance can cause excessive line pressure.

Having described the invention, it should be understood that although a preferred embodiment has been disclosed herein, other modifications and embodiments can be utilized without departing from the spirit of this invention. Therefore, this invention should not be limited to only the embodiment illustrated.

The embodiments of the invention in which an exclusive property or privilege is claimed are defined as follows.

1. An apparatus for handling ink comprising:

a container for receiving and dispensing ink; and a bucket support positioned over said container, said bucket support having a first wiper arm extending upwardly from said container and a second wiper arm connected to and extending outwardly from said first wiper arm over said container, said first and second wiper arms being interconnected at an angle and suitable for supporting an ink supply bucket up-side-down over said container, the angle therebetween being properly sized so that the first and second wiper arms can contact the supply bucket side wall and bottom simultaneously when a supply bucket is placed up-side-down thereon and rotated, said first and second wiper arms being thus adapted to contact the supply bucket side wall and bottom, respectively, to wipe away residue ink clinging to the supply bucket side wall and bottom so that the ink can be wiped from the supply bucket whereafter the ink falls down into said container for receiving and dispensing ink.

2. The apparatus defined in claim 1 wherein said first and second wiper arms include a first and second flexible member fastened to said first and second wiper arms respectively to provide a squeegee-type wiping action.

3. The apparatus defined in claim 1 wherein said angle formed by said first and second wiper arms is adjustable to a fixed angle to allow use with different supply buckets.

4. The apparatus defined in claim 1 including a cover for said container, said cover including an annular opening adapted to abut said supply bucket side wall and further including an outer edge which extends over the edge of said container thereby cooperating with said supply bucket to form a substantially air tight closure over said container.

5. An apparatus for handling ink comprising:

a container for receiving and dispensing ink;

a bucket support positioned over said container, said bucket support having a first wiper arm extending upwardly from said container and a second wiper arm connected to and extending outwardly from said first wiper arm and over said container, said first and second wiper arms being interconnected at an angle and suitable for supporting an ink supply bucket up-side-down over said container, the angle therebetween properly sized such that the first and second wiper arms can contact the supply bucket side wall and bottom simultaneously when a supply bucket is placed up-side-down thereon; and a cover for said container, said cover including an annular opening which abuts said supply bucket side wall and further including an outer edge which extends over the edge of said container thereby cooperating with said supply bucket to form a substantially air tight closure over said container, said cover including two "C" shaped members which pivot between an open position allowing placement of said supply bucket on said bucket support, and a closed position which mateably engages said supply bucket to form the substantially air tight closure over said container.

6. An apparatus for removing ink from a supply bucket having a bottom and side wall, the apparatus comprising:

a bucket support having first and second scrapers, said bucket support extending upwardly and adapted to be positioned over a holding container for receiving ink;

said first scraper extending upwardly and having an upper end; and said second scraper connected to the upper end of said first scraper and extending at an angle therefrom, said angle being such that said first scraper is adapted to contact a supply bucket side wall and said second scraper is adapted to contact a supply bucket bottom thus permitting said first and second scrapers to wipe a supply bucket substantially clean as said supply bucket is rotated while resting up-side-down on said first and second scrapers.

7. A method for removing ink from a supply bucket having a bottom and side wall comprising:

providing a container for receiving and dispensing ink;

providing a bucket support positioned over said container, said bucket support having two wiping members adapted to wipingly contact the bottom and side wall of a supply bucket;

providing a cover which is moveable between an open position to allow said supply bucket to be placed on said bucket support, and a closed position wherein said cover closes on said container and cooperates with said supply bucket to form a substantially air tight closure over said container;

placing the supply bucket up-side-down on the bucket support with said cover open;

closing said cover on said supply bucket; and rotating said supply bucket in an up-side-down position on said bucket support such that said bottom and side wall of said supply bucket are wiped substantially clean and said ink falls into said container.

* * * * *

UNITED STATES PATENT AND TRADEMARK OFFICE

CERTIFICATE OF CORRECTION

PATENT NO. : 5,275,100

DATED : January 4, 1994

INVENTOR(S) : Charles W. Harpold et al.

It is certified that error appears in the above-identified patent and that said Letters Patent is hereby corrected as shown below:

Column 3, line 3
"and ar" should be --and are--;

Column 3, line 21
"ar 68" should be --arm 68--;

Column 3, line 28
"arm 68" should be --arms 68--;

Column 3, line 31
"at a" should be --at an--;

Column 3, line 50
"opening 2" should be --opening 28--;

Column 4, line 16
"ink r" should be --ink or--;

Column 5, line 54
"t be" should be --to be--;

Signed and Sealed this

Sixteenth Day of August, 1994

*Attest:*

*Attesting Officer*

BRUCE LEHMAN

*Commissioner of Patents and Trademarks*